US008810431B2

(12) United States Patent
Mudalige et al.

(10) Patent No.: US 8,810,431 B2
(45) Date of Patent: Aug. 19, 2014

(54) HIGHWAY MERGE ASSISTANT AND CONTROL

(75) Inventors: Upali Priyantha Mudalige, Oakland Township, MI (US); Bakhtiar Brian Litkouhi, Washington, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 376 days.

(21) Appl. No.: 13/277,263

(22) Filed: Oct. 20, 2011

(65) Prior Publication Data

US 2013/0099911 A1 Apr. 25, 2013

(51) Int. Cl.
*G08G 1/16* (2006.01)

(52) U.S. Cl.
USPC ..... 340/903; 340/435; 340/436; 340/905; 701/301

(58) Field of Classification Search
USPC ..... 340/903, 435, 938, 436; 701/23, 28, 29, 701/96, 117, 301
See application file for complete search history.

(56) References Cited

U.S. PATENT DOCUMENTS

| | | | | |
|---|---|---|---|---|
| 6,115,652 | A * | 9/2000 | Sato et al. | 701/28 |
| 2005/0015203 | A1* | 1/2005 | Nishira | 701/301 |
| 2006/0235597 | A1* | 10/2006 | Hori et al. | 701/96 |
| 2010/0292886 | A1* | 11/2010 | Szczerba et al. | 701/29 |

* cited by examiner

*Primary Examiner* — Brent Swarthout

(57) ABSTRACT

A vehicle merge control system includes a host communication system in a host vehicle for exchanging vehicle position and kinematics data with a remote communication system in at least one remote vehicle. A vehicle host processor determines respective positions and paths of travel of the at least one remote vehicle and the host vehicle. The host processor determines a time to intersect based on the positions and predicted paths of travel between the host vehicle and remote vehicle during a merging maneuver. A host vehicle is configured to transmit a host vehicle intention message from the host communication system to the remote communication system for negotiating a merging position between the host vehicle and the at least one remote vehicle. The host vehicle executes the merging maneuver using the negotiated merging position.

22 Claims, 4 Drawing Sheets

HIGHWAY MERGE ASSISTANT AND CONTROL

BACKGROUND OF INVENTION

An embodiment relates generally to vehicle communication and traffic merging behaviors.

Merging maneuvers includes at least one vehicle traveling in separate lanes wherein the vehicle must merge into a single lane of travel. The merging maneuver is performed implicitly by the driver of each vehicle wherein the driver individually decides whether they should merge in front of or behind the other vehicle. That is, each driver is not in communication with the other drivers and must make a decision on what merging position should be executed based on their observance of the relative position and speed between the two vehicles. The merging vehicle may speed up to merge ahead of the vehicle on the thoroughfare or slow down to merge behind the vehicle on the thoroughfare. Alternatively, the vehicle on the thoroughfare may speed up or slow down to accommodate the merging vehicle. In addition, the vehicle traveling on the thoroughfare may change lanes to accommodate the merging vehicle.

Often times drivers may choose to perform the same action as the other vehicle resulting in both vehicles accelerating or both vehicle decelerating at the same time thereby causing one of the vehicles to brake after it is realized that both vehicles are attempting a same acceleration action or deceleration action. As a result, one of the vehicles may brake to avoid a collision when it is apparent to one of the drivers that both drivers have the same intention such as merging ahead of the other vehicle. A change of speed such as braking may cause a chain of braking events for vehicles trailing the braking vehicle, which may ultimately lead to a traffic slow down or collision.

SUMMARY OF INVENTION

An advantage of an embodiment is cooperative merging of a vehicle onto a thoroughfare of a traveled road. A host vehicle communicates with a remote vehicle for exchanging position and kinematics data for determining whether the vehicles will intersect at a merging location based on their estimated paths of travel. Based on the position and kinematics data, the host vehicle transmits a merging intention message to the remote vehicle for negotiating a merging position. Upon acceptance of the negotiated merging position, the host vehicle will execute the negotiated merging maneuver for merging the vehicles. The advantage is that both vehicles are aware of the negotiated merging positions which allow a cooperative merging of the merging vehicle in the thoroughfare which decreases the likelihood of either vehicle having to decelerate at a large rate to accommodate the merging event. This also reduces the likelihood of potential vehicle crashes in highway merging situations.

An embodiment contemplates a vehicle merge control system that includes a host communication system in a host vehicle for exchanging vehicle position and kinematics data with a remote communication system in at least one remote vehicle. A vehicle host processor determines respective positions and paths of travel of the at least one remote vehicle and the host vehicle. The host processor determines a time to intersect based on the positions and predicted paths of travel between the host vehicle and remote vehicle during a merging maneuver. A host vehicle is configured to transmit a host vehicle intention message from the host communication system to the remote communication system for negotiating a merging position between the host vehicle and the at least one remote vehicle. The host vehicle executes the merging maneuver using the negotiated merging position.

DETAILED DESCRIPTION

Figure 1:
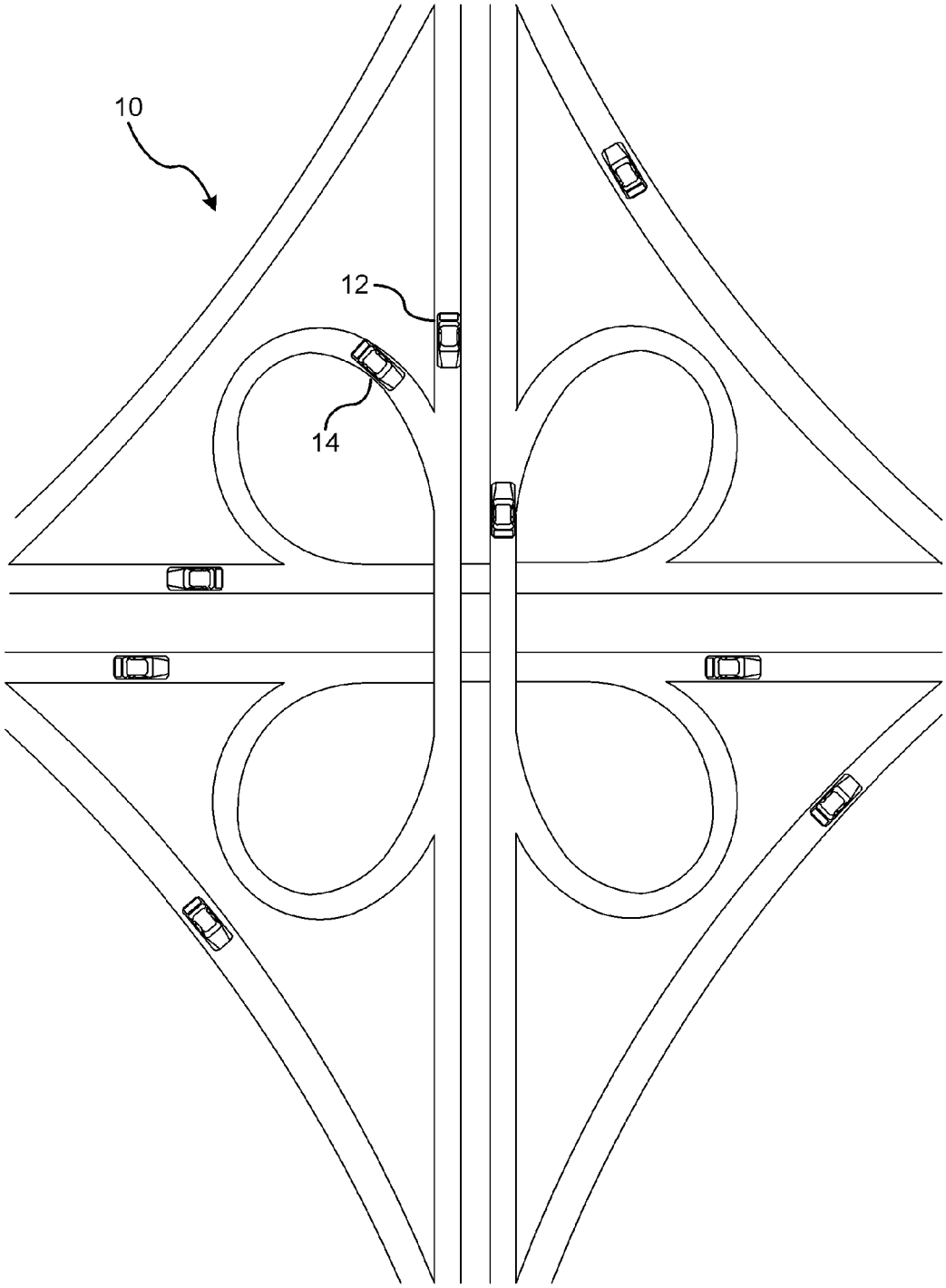
FIG. 1 is a roadway infrastructure showing a plurality of merging locations.

FIG. 1 illustrates a roadway infrastructure 10 that includes a plurality of merging locations, such as a freeway interchange structure. The freeway interchange structure includes a plurality of entrance ramps and exit ramps wherein vehicles enter and exit thoroughfares. A plurality of vehicles are shown where a vehicle traveling on an entrance ramp merges onto a thoroughfare traveled by a second vehicle. A vehicle traveling on the entrance ramp can either merge behind of the other vehicle, merging ahead of the other vehicle, or the vehicle on the thoroughfare can move into an adjacent lane if available to allow the merging vehicle to enter the thoroughfare.

To cooperatively execute a merging maneuver, a host vehicle 12 and a remote 14 vehicle communicate with one over a communication system. The communication system may include a V2X communication system which is also known as a vehicle-to-vehicle (V2V) communication system, an infrastructure-to-vehicle (I2V) communication system, and a vehicle-to-infrastructure (V2I) communication system. In a V2I or I2V communication system, messages are broadcast to other vehicles directly. In a V2I or a 12V communication system, messages are broadcast between a vehicle and an entity. The messages are broadcast indirectly to other vehicles via a fixed infrastructure or entity other than a vehicle.

Data communicated between vehicles may include, but is not limited to, position data, kinematics data, path history data, projected travel path data, range data, range rate of change data, course heading data, and navigation data. The data is broadcast between vehicles for determining when a vehicle will enter a merging zone.

Figure 2:
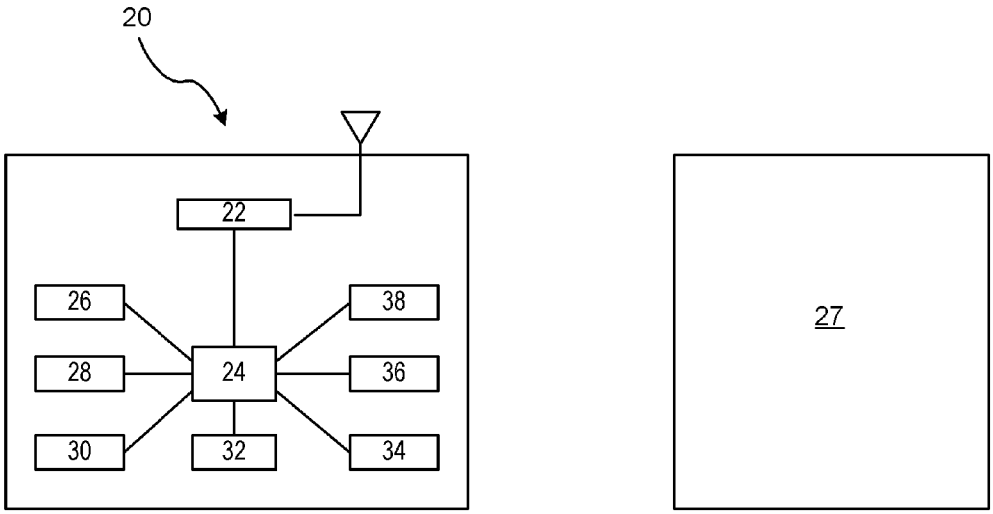
FIG. 2 is a block diagram for the vehicle merge control system for a host vehicle.

FIG. 2 illustrates a block diagram for the vehicle merge control system for a host vehicle. The vehicle merge control system 20 includes a host communication system 22, a processing unit 24, and at least one human machine interface device (HMI) 26.

The host communication system 22 exchanges messages with a remote communication system 27. The vehicle position, kinematics of the vehicle path history, projected path, merge intentions, handshaking data and the other parameters as described earlier may be communicated as part of a beacon message that is broadcast periodically between vehicles.

A global positioning system (GPS) device 28 may be utilized by the host vehicle 12 for determining and maintaining the position and kinematics data of the host vehicle 12. Onboard sensors 30 may also be utilized on the host vehicle 12 for detecting the presence of remote vehicles, objects, and road markings along the route of travel. Onboard sensors may also be used to determine vehicle location and improve the vehicle positioning accuracy when GPS availability is limited.

The processing unit 24 receives the parameter data of remote vehicles via the host communication system 22 and utilizes the data in cooperation with host vehicle parameter data to detect an upcoming merging event. The host vehicle parameter data utilized includes, but is not limited to, data from a GPS device 28, onboard sensors 30, a navigation device 32, digital maps 34, off-vehicle services (e.g., OnStar®) 36, and other vehicle modules 38.

The processing unit 24 may function in either a merge assist mode or merge control mode. In the merge assist mode, the processing unit 24 identifies the upcoming merging location, determines whether a merging event is likely to occur, and notifies the driver of the host vehicle of the upcoming merging event. Notification to the driver can be actuated utilizing the HMI 26. The processing unit 24 will coordinate the negotiation of the driver's merging intent with the remote vehicle 14 so that a coordinated merging maneuver can be executed by the driver of the host vehicle 12. The host vehicle communication system 22 may be used to transmit the driver's merging intent. Alternatively, the host vehicle communication system may include more than one communication channel for communicating the driver's merging intent and for receiving the remote vehicle's acceptance of the driver's merging intent. This allows messages to be transmitted on demand when required as opposed to V2X messaging which periodically transmits a beacon message containing the parameter data. The processing unit 24 will coordinate the response from the remote vehicle and inform the driver whether the negotiated merging positions are accepted. The communication from the remote vehicle may be output to the driver via the HMI 26 or any other device that is capable of communicating with the driver of the host vehicle 12.

In merge control mode, the processing unit 24 identifies the upcoming merging location, determines whether a merging event is likely to occur, and then coordinates the negotiated merging maneuver autonomously without driver intervention. The processing unit 24 continuously exchanges parameter data with the remote vehicle 14 and utilizes onboard devices as described above to continuously determine the projected paths of both vehicles and a time-to-intersect. Based on the positions and vehicle dynamics, the processing unit 24 determines a merging position and autonomously negotiates the merging position with the remote vehicle 14 via the communication system as described above. Once the processing unit 24 receives acceptance of the negotiated merging position, the processing unit 24 will then control the vehicle for executing the merging maneuver. The merging maneuver may include speeding up the host vehicle 12 to merge ahead of the remote vehicle 14, slowing down the host vehicle 12 for merging behind the remote vehicle 14, maintaining a same speed to allow the remote vehicle 14 to perform the merging maneuver, or changing lanes to allow the remote vehicle 14 to merge onto the thoroughfare 40.

The processing unit 24 may be a control unit that controls the power train or steering controls for completing the merging maneuver. Alternatively, the processing unit 24 may operate in cooperation with other existing modules in the host vehicle 12 for executing the merging maneuver.

It should be understood that the remote vehicles may contain the same architecture as the host vehicle communicating and executing the merging maneuver.

Figure 3:
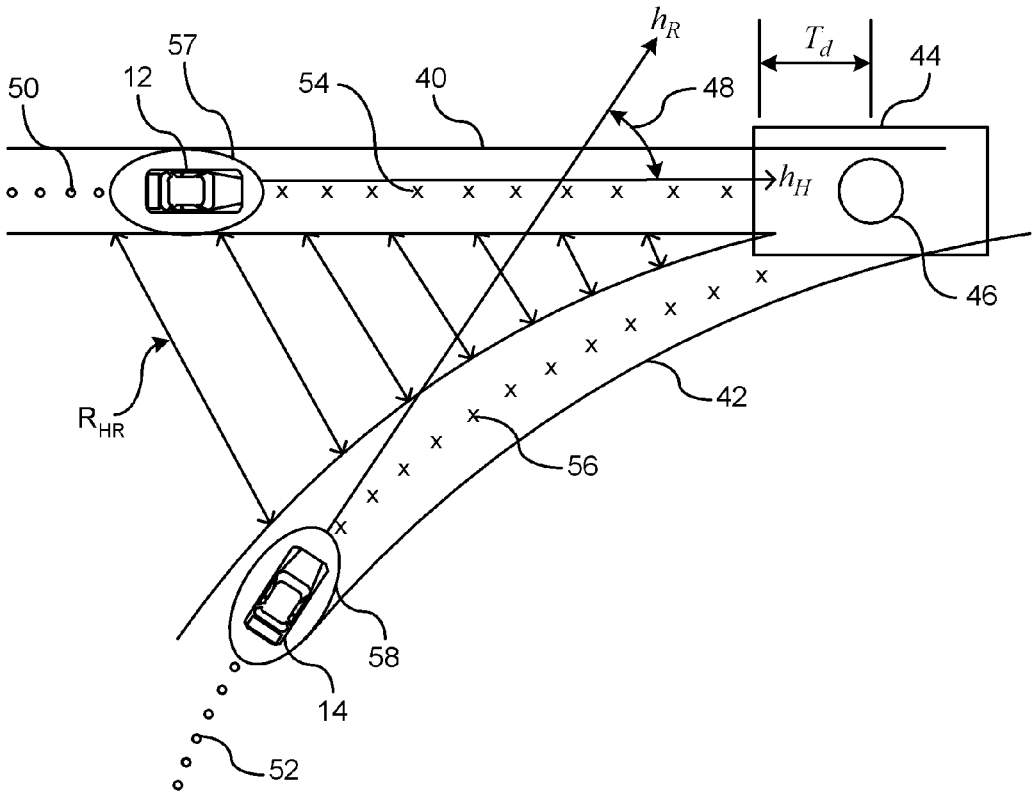
FIG. 3 is a exploded view of a thoroughfare merging with an entrance lane.

FIG. 3 illustrates an exploded view of a thoroughfare 40 merging with an entrance lane 42 for describing the merging maneuver. A host vehicle 12 and a remote vehicle 14 are shown entering a merging zone 44 which is a point of intersection of the thoroughfare 40 and the entrance lane 42. Various position, range, and speed parameters with respect to the host vehicle 12 and the remote vehicle 14 are used to establish a time-to-intersect (TTI) at an intersecting point 46. It should be understood that both the host vehicle 12 and the remote vehicle 14 may transmit and receive position, heading, and kinematics data and determine the parameters that will be discussed herein.

A range $R_{HR}$ is continuously estimated between the vehicles. The range $R_{HR}$ represents a direct linear distance between the host vehicle 12 and the remote vehicle 14 as each vehicle travels along their respective roads until the vehicles reach the merging zone 44.

A heading of the host vehicle $h_H$ is constantly updated and a heading of the remote vehicle $h_R$ is constantly updated. An instantaneous heading difference $dH_{HR}$ shown generally at 48 is updated. A path history 50 of the host vehicle 12 and the path history 52 of the remote vehicle 14 are maintained and used in cooperation with the range and heading information for determining predicted forward path geometry 54 for the host vehicle 12 and a predicted forward path geometry 56 for the remote vehicle 14. The predicted forward path geometry for both respective vehicles may be determined by digital maps and/or onboard vehicle sensors. The path history for both respective vehicles may be determined by GPS and/or onboard sensors or maps.

The TTI is based on the motion paths at a given instance at time (j) is determined as a function of the range between the vehicle motion paths and the velocity at time (j) and is determined by the following formula:

$$TTI=(S_j/v_j)$$

where $S_j$ is a distance along the motion paths between current vehicle position and the intersecting location 46 at time (j) and $v_j$ is a velocity of the vehicle at time (j).

A predicted collision time window (PCTW) may be determined as a function of the TTI. The PCTW is represented by the following formula:

$$(TTI-T_d)<t<(TTI+T_d)$$

wherein TTI is a time-to-intersect motion paths of the respective vehicles and $T_d$ is an estimated variation of the time-to-intersect based on uncertainty of estimating vehicle dynamics, vehicle positioning, traffic, and environmental conditions such as rain, snow and road condition. Imaginary safety envelops 57 and 58 are constructed around the host vehicle 12 and remote vehicle 14, respectively. The safety envelops may be of any shape, such as oval, rectangle, circle etc. Vehicle geometric center and safety envelop center may not necessarily coincide. The safety envelope provides a margin of safety due to vehicle positioning errors and other measurement errors. The $T_d$ is estimated by the maximum safety envelop length between the host and remote vehicles. The size of the safety envelops depend on, but are not limited to, positioning accuracy, vehicle dynamics, traffic and environmental conditions. $T_d$ may be represented as max length $(SE_j, SE_j)/2$.

After the determination is made that the PCTW shows that the both vehicles will be within the merger zone 44 at a same instance of time, messages are exchanged between the host vehicle 12 and the remote vehicle 14 for negotiating the merging position of each vehicle.

Figure 4:
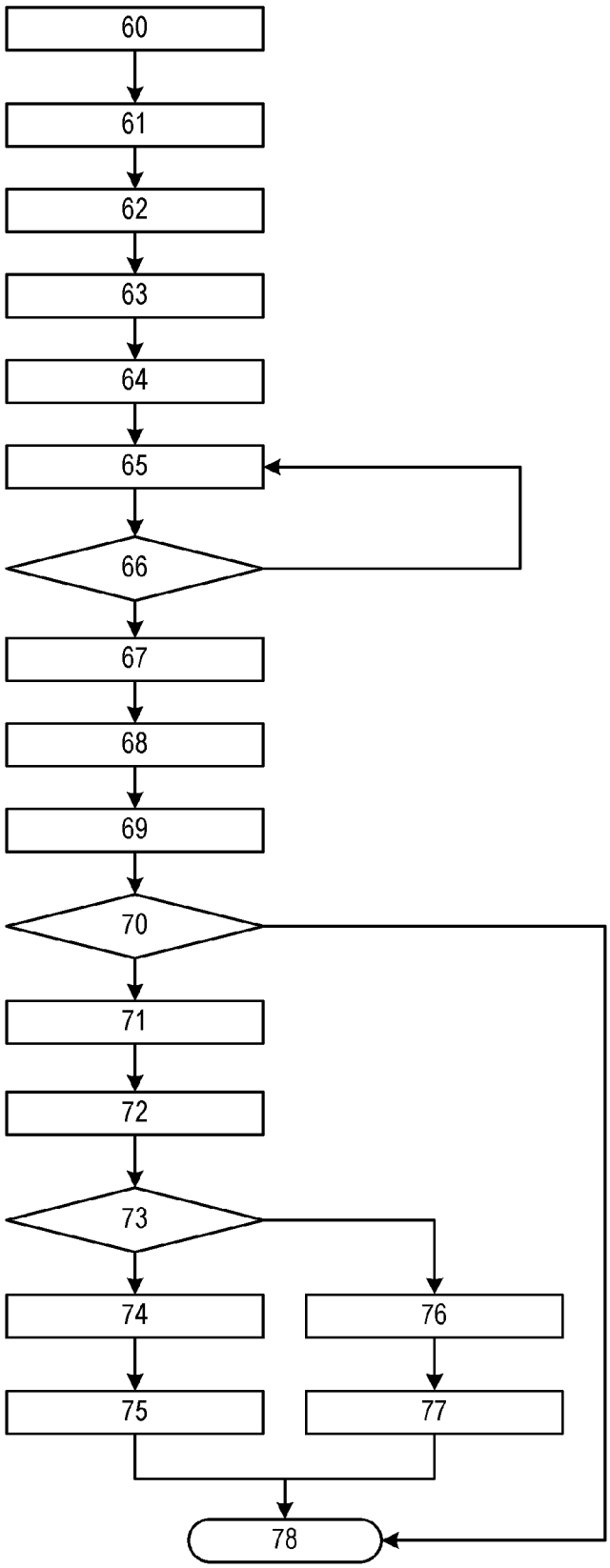
FIG. 4 is a flowchart of a method for cooperatively performing a merging maneuver.

FIG. 4 illustrates a flowchart of a method for negotiating merger positions between the host vehicle and the remote vehicle. In step 60, data is exchanged between the vehicles via V2X communication system for determining whether the vehicle is on a merging onset. The merging onset is defined herein as any time from when a host vehicle is predicting an intersection of future paths with a remote vehicle at a merging location to a time when the host vehicle negotiates the right-of-way with the remote vehicle at the merging location and completes the merging maneuver. Data includes, but is not limited to, position data, kinematics data, path history data and predicted path data.

In step 61, an upcoming merging location such as an upcoming highway entrance is identified. The upcoming highway entrance can be obtained, for example, from map data for example.

In step 62, a distance to the entrance ramp and a location a location of the entrance ramp are calculated based on GPS and on-board devices. Alternatively, these parameters may be calculated based on V2X information from remote vehicles.

In step 63, a determination is made whether the host vehicle is traveling on the thoroughfare or whether the host vehicle is traveling on the entrance ramp (e.g., merging road). That is, the host vehicle identifies itself as a thoroughfare host vehicle or a merging host vehicle. Such a determination can be identified using maps, vehicle speed, vehicle headings, steering angle histories relative to current steering angle, path history, and/or forward path geometry.

Figure 5:
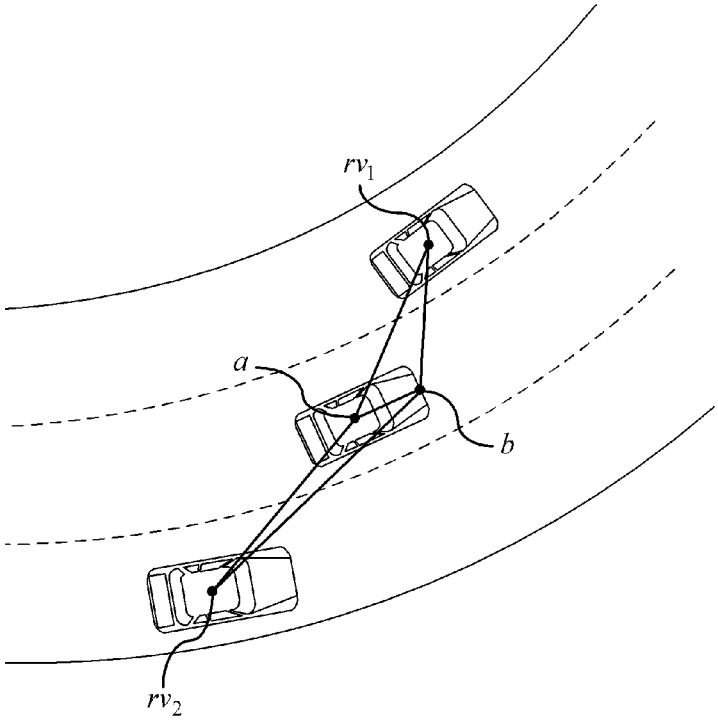
FIG. 5 is a geometric illustration for determining a position of a merging lane.

In step 64, a determination is made whether the entrance ramp is on the right side or left side of the vehicle. Such information may be determined from map data. If map data is not available, then such information can be determined from on-board sensor data or position data as communicated in V2X communications. Referring to FIG. 5, a geometric illustration of the host vehicle relative to remote vehicles is shown for determining which side the merging lane is situated. The host vehicle 12 can determine the whether the merging lane is on the right hand side of the host vehicle or the left hand side of the host vehicle depending on a position of the other remote vehicles traveling along the thoroughfare relative to the host vehicle. The host vehicle 12 first determines its positional relevant to remote vehicles. The point a represents the position of the host vehicle 12. The point b represents the front center of the host vehicle 12. The point $rv_1$ represents a position of a first remote vehicle and $rv_2$ represents a position of the second remote vehicle. The following equation is used to determine which side of the vehicle a remote vehicle is situated and is represented by:

$$(b_x-a_x)*(R_y-a_y)-(R_x-a_x)*(b_y-a_y)$$

where $a_x$ and $a_y$ are longitudinal coordinates of the point a, where $b_x$ and $b_y$ are lateral and longitudinal coordinates of the point b, and $R_x$ and $R_y$ represent the longitudinal and lateral position coordinates of the location of a remote vehicle such as $rv_1$ or $rv_2$.

If the results from the previous equation are positive, then the respective remote vehicle traveling along the thoroughfare is driving on the left side of the vehicle, and therefore, the merging lane is located on the right side of the vehicle. If the results from the previous equation are negative, then the respective remote vehicle traveling along the thoroughfare is driving on the right side of the vehicle, and therefore, the merging lane is located on the left side of the vehicle.

Referring again to FIG. 3, in step 65, the instantaneous heading difference $dH_{HR}$ and the distance between the vehicle motion paths $R_{HR}$ are continuously monitored In step 66, a determination is made as to whether both instantaneous heading difference $dH_{HR}$ and the distance between the vehicle motion paths $R_{HR}$ are decreasing. A decrease in both parameters indicates that their crossing paths are nearing one another. If the determination is made that the instantaneous heading difference $dH_{HR}$ and the distance between the vehicle motion paths $R_{HR}$ are not decreasing then the routine returns to step 65. If the determination is made that $dH_{HR}$ and $R_{HR}$ are decreasing, then the routine proceeds to step 67.

In step 67, the host vehicle will identify itself as a thoroughfare vehicle or a merging vehicle and continuously exchange kinematics, position, path history, and predicted path data with the remote vehicle.

In step 68, the TTI and the $T_d$ are determined.

In step 69, the PCTW is determined as a function of the TTI and the $T_d$.

If step 70, a determination is made whether the PCTW is within a determined range. If the PCTW is not within the predetermined range indicating that there is no collision and that the vehicles can merge without corroboration from one another, then the routine proceeds to step 78 where the routine ends. If the determination is made that the PCTW is within the predetermined range, then routine proceeds to step 71.

In step 71, a host vehicle intention message is communicated to the remote vehicle. The host vehicle intention message communicates the intention of the host vehicle of whether it intends to merge ahead of the remote vehicle, or behind the remote vehicle, or change lanes to allow the merge to occur.

If the vehicle merge control system is a merge assist system, then the driver of the vehicle determines its intended merging position and registers its intention of the merge position through the vehicle human machine interface (HMI). The HMI may include, but is not limited to, a voice command, an in-vehicle electronic switch, or a touch screen. The merging intentions of the driver communicated through the HMI are transmitted to the remote vehicle via the host vehicles communication system and the remote vehicles communication system. It should be understood that the merging intention may be communicated over a separate communication system (e.g., OnStar®) different than that which is used to communicate the position data, kinematics data, and path history and predicted path data. This may be done for transmitting messages at a faster rate and on demand, whereas position and kinematics data are often transmitted as a periodic beacon message at predetermined time intervals.

If the vehicle merge control system is a merge control system that autonomously controls the merging, then a processor of the host vehicle will determine a desired merging position as a function of a predicted time-of-arrival at the merging location in addition to other position and kinematics data. As described in earlier, the communication system that transmits the merge intention may be performed over a communication channel or system that is different than that which is used to transmit the beacon message.

In step 72, a determination is made as to whether the remote vehicle has received the host vehicle merging intentions and has accepted the merger intentions. If an acceptance has been received, then the then the routine proceeds to step 73. If the remote vehicle does not accept the merger intentions of the host vehicle, then the system will execute the negotiated merging maneuver based on a predetermined scheme, such as a first to arrive-merge ahead strategy, or a last to arrive-merge behind strategy.

In step 73, in response to receiving an acceptance of the merging intention of the vehicle, a determination is made whether to provide a manual notification or autonomously perform the merging maneuver. If the vehicle merge control system is in a merge assist mode, then the routine proceeds to step 74 where a notification is provided to the driver of the vehicle that the remote vehicle has accepted the merging intention of the host vehicle. The notification can be in the form of a visual, audible or haptic feedback. This can be executed through the any HMI of the vehicle.

In step 75, the driver of the vehicle then executes the merging maneuver utilizing the merging position as negotiated between the host vehicle and the remote vehicle. After the merge maneuver is complete, the routine proceeds to step 78 where the routine ends.

In step 73, if the system is in a merge control mode which autonomously merges the vehicle, then the routine proceeds to step 76. In step 76, the host vehicle and the remote vehicle continuously exchange, sense, and track each others speed profiles and lane positioning to coordinate the merging maneuver.

In step 77, a speed of the host vehicle may be increased or deceased, or a lane change may be executed for completing the merging maneuver. It should be understood that the remote vehicle may execute speed changes to help facilitate the merging maneuver with the host vehicle.

In step 78, the merging routine ends and the routine returns to step 60 for detecting a next merging location.

While certain embodiments of the present invention have been described in detail, those familiar with the art to which this invention relates will recognize various alternative designs and embodiments for practicing the invention as defined by the following claims.

What is claimed is:

1. A vehicle merge control system comprising:

a host communication system in a host vehicle for exchanging vehicle position and kinematics data with a remote communication system in at least one remote vehicle; and a vehicle host processor for determining respective positions and paths of travel of the at least one remote vehicle and the host vehicle, the host processor determining a time to intersect based on the positions and predicted paths of travel between the host vehicle and remote vehicle during a merging maneuver;

wherein the host vehicle transmits a host vehicle intention message from the host communication system to the remote communication system for negotiating a merging position between the host vehicle and the at least one remote vehicle, wherein negotiating the merging position includes communicating to the host vehicle at least one of an acceptance and non-acceptance of the merging position by the remote communication system in response to the host vehicle intention message, and wherein the host vehicle executes the merging maneuver using the negotiated merging position and wherein the host vehicle executes the merging maneuver using the negotiated merging position.

2. The vehicle merge control system of claim 1 further comprising a merge alert indicator in the host vehicle for alerting a driver of an upcoming merging event with the at least one remote vehicle, and wherein the driver manually establishes the negotiated merging position.

3. The vehicle merge control system of claim 2 wherein the driver manually establishing the negotiated merging position includes the driver conveying in the host vehicle intention message a driver's desire to merge behind the remote vehicle.

4. The vehicle merge control system of claim 2 wherein the driver manually establishing the negotiated merging position includes the driver conveying in the host vehicle intention message a driver's desire to merge in ahead of the remote vehicle.

5. The vehicle merge control system of claim 2 wherein the driver manually executes the merging maneuver using the negotiated merging position in response to an acceptance of the merging position by the remote vehicle.

6. The vehicle merge control system of claim 1 wherein the host processor automatically determines a desired merging position based on the positions and paths of travel of the host vehicle and at least one remote vehicle.

7. The vehicle merge control system of claim 6 wherein the time-to-intersect between the host vehicle and the remote vehicle is based on whether the host vehicle and the remote vehicle will collide within a respective window of time, wherein the predicted collision time window is represented by the following formula:

$$(\mathrm{TTI}-T_d)<t<(\mathrm{TTI}+T_d)$$

wherein TTI is a time-to-intersect motion paths of the respective vehicles, $T_d$ is an estimated variation of the time-to-intersect based on an uncertainty of estimating vehicle dynamics, vehicle positioning, traffic, and environmental conditions.

8. The vehicle merge control system of claim 6 wherein merging position of the host vehicle is based on a determination of a time-to-arrival at a predicted merging location.

9. The vehicle merge control system of claim 8 wherein processor determines that the host vehicle will merge ahead of the remote vehicle based on the host vehicle being first to arrive at the predicted merging location relative to the remote vehicle.

10. The vehicle merge control system of claim 8 wherein processor determines that the host vehicle will merge behind of the remote vehicle based on the host vehicle being last to arrive at the predicted merging location relative to the remote vehicle.

11. The vehicle merge control system of claim 8 wherein processor determines that the host vehicles merging position based on a position of other remote vehicles predicted location relative to the host vehicle and the remote vehicle at the predicted merging location.

12. The vehicle merge control system of claim 2 wherein the host vehicle autonomously changes speed to for executing the merging maneuver.

13. The vehicle merge control system of claim 2 wherein the host vehicle autonomously changes lanes for executing the merging maneuver.

14. The vehicle merge control system of claim 1 the host communication system is part of a vehicle-to-vehicle communication system.

15. The vehicle merge control system of claim 1 wherein the host communication system is part of an infrastructure-to-vehicle communication system.

16. The vehicle merge control system of claim 1 wherein the host communication system is a combination of a vehicle-to-vehicle communication system and an infrastructure-to-vehicle communication system.

17. A vehicle merge control system comprising:

a host communication system in a host vehicle for exchanging vehicle position and kinematics data with a remote communication system in at least one remote vehicle; and a vehicle host processor for determining respective positions and paths of travel of the at least one remote vehicle and the host vehicle, the host processor determining a time to intersect based on the positions and predicted paths of travel between the host vehicle and remote vehicle during a merging maneuver, the host communication system exchanging path history and projected travel path data with the remote communication system, wherein the path history and projected travel path data is utilized by the host processor for determining a time to intersect during the merging maneuver;

wherein a host vehicle is configured to transmit a host vehicle intention message from the host communication system to the remote communication system for negotiating a merging position between the host vehicle and the at least one remote vehicle, and wherein the host vehicle executes the merging maneuver using the negotiated merging position.

18. The vehicle merge control system of claim 17 wherein the host processor determines whether the host vehicle is on a merging onset.

19. The vehicle merge control system of claim 18 wherein the host processor utilizes the path history and projected travel path data of the host vehicle and remote vehicle for determining whether the host vehicle is on a merging onset.

20. The vehicle merge control system of claim 18 wherein the host processor utilizes range data and range rate of change data between the host vehicle and remote vehicle for determining whether the host vehicle is on a merging onset.

21. The vehicle merge control system of claim 18 wherein the host processor utilizes heading course changes between the host vehicle and remote vehicle for determining whether the host vehicle is on a merging onset.

22. The vehicle merge control system of claim 18 wherein the host processor utilizes navigation maps for determining whether the host vehicle is on a merging onset.

* * * * *